US010451394B2

(12) United States Patent
Basham et al.

(10) Patent No.: US 10,451,394 B2
(45) Date of Patent: Oct. 22, 2019

(54) CONTAINMENT VESSEL AND METHOD FOR STOWING A HIGH ENERGY DENSITY DEVICE

(71) Applicant: The Boeing Company, Chicago, IL (US)

(72) Inventors: Richard R. Basham, Kent, WA (US); Thomas A. Rogers, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 70 days.

(21) Appl. No.: 15/916,486

(22) Filed: Mar. 9, 2018

(65) Prior Publication Data

US 2019/0277611 A1 Sep. 12, 2019

(51) Int. Cl.
*F42D 5/045* (2006.01)
*F42B 39/24* (2006.01)
*F42B 39/14* (2006.01)

(52) U.S. Cl.
CPC ..... *F42D 5/045* (2013.01); *F42B 39/14* (2013.01); *F42B 39/24* (2013.01)

(58) Field of Classification Search
CPC ..... F42B 39/14; F42B 39/24; F42D 5/045
USPC ..... 206/3; 220/554–557; 102/331, 464; 86/50; 53/446
See application file for complete search history.

(56) References Cited

U.S. PATENT DOCUMENTS 3,160,061 A * 12/1964 Moy ..... F41F 3/07 89/1.816
4,055,247 A 10/1977 Benedick et al.
4,248,342 A * 2/1981 King ..... F42B 39/14 109/49.5
4,325,309 A * 4/1982 King ..... F42D 5/045 109/49.5
4,326,468 A * 4/1982 King ..... E04H 9/10 109/49.5
4,347,796 A * 9/1982 King ..... F42D 5/045 109/49.5
4,389,947 A 6/1983 King et al.
4,889,258 A 12/1989 Yerushalmi
5,798,477 A * 8/1998 Givens ..... F42B 3/26 102/302
6,196,107 B1 3/2001 Hoffman et al.
(Continued)

OTHER PUBLICATIONS http://www.oshodefence.com/tec.php.
https://commons.wikimedia.org/wiki/File:FBI_Bomb_containment_vessel.jpg.
http://www.airolusion.com/datasheets/vorspheredatasheetusletter.pdf.

*Primary Examiner* — Chun Hoi Cheung
(74) *Attorney, Agent, or Firm* — Walters & Wasylyna LLC

(57) ABSTRACT

A containment vessel for stowing a high energy density device therein includes a housing, a plurality of discs, and a separable collar. The housing includes a base, a sidewall enclosure extending upwardly from the base, the sidewall enclosure defining a housing cavity and an opening at a top end thereof, and a flange extending circumferentially outwardly from the sidewall enclosure. The separable collar has first, second, and third grooves on an inner circumference of the separable collar. The first groove is configured to receive the flange of the housing. The second and third grooves are configured to receive first and second of the plurality of discs.

20 Claims, 19 Drawing Sheets

(56) References Cited

U.S. PATENT DOCUMENTS

| | | | | |
|---|---|---|---|---|
| 6,386,110 | B1 * | 5/2002 | Landman | C06B 45/00<br>102/288 |
| 6,581,521 | B1 * | 6/2003 | Dixon | F42B 12/46<br>102/334 |
| 6,644,165 | B1 | 11/2003 | King | |
| 7,642,473 | B2 | 1/2010 | Kim | |
| 2005/0150369 | A1 | 7/2005 | Lacombe et al. | |
| 2006/0108237 | A1 * | 5/2006 | Sansolo | F42B 39/14<br>206/3 |
| 2016/0359154 | A1 | 12/2016 | Harris et al. | |

* cited by examiner

6

CONTAINMENT VESSEL AND METHOD FOR STOWING A HIGH ENERGY DENSITY DEVICE

FIELD

This application relates to containment vessels and methods for stowing high energy density devices.

BACKGROUND

There are circumstances in which it is desirable to protect a surrounding area from a high energy density device by suppression of an associated high-pressure wave and fragmentation.

In a gas-sealed containment vessel, a challenging aspect is accommodating for stresses caused by containment of a high-pressure wave emanating from a high energy density device, thereby necessitating a heavy structure for the containment vessel.

Robotic devices are becoming a common tool for handling high energy density devices. In order to minimize design constraints for the robot, the containment vessel used for stowing the high energy density device should be as small and light as possible, and the means for closing the containment vessel should be simple.

Accordingly, those skilled in the art continue with research and development efforts in the field of containment vessels and methods for stowing high energy density devices.

SUMMARY

In one embodiment, a containment vessel for stowing a high energy density device therein includes a housing, a plurality of discs, and a separable collar. The housing includes a base, a sidewall enclosure extending upwardly from the base, the sidewall enclosure defining a housing cavity and an opening at a top end thereof, and a flange extending circumferentially outwardly from the sidewall enclosure. The separable collar has first, second, and third grooves on an inner circumference of the separable collar. The first groove is configured to receive the flange of the housing. The second and third grooves are configured to receive first and second of the plurality of discs.

In another embodiment, a containment vessel for stowing a high energy density device therein includes a housing, a cover, and at least a first plate. The housing includes a base and a sidewall enclosure extending upwardly from the base to define a housing cavity and an opening at a top end thereof. The sidewall enclosure has an array of ventilation holes penetrating from the housing cavity to an exterior surface of the sidewall enclosure. The cover is for covering the top end of the housing cavity. The first plate is retained in a spaced relationship over the base of the housing such that a first plurality of the ventilation holes are disposed between the base of the housing and the first plate. The first plate includes a central opening having a first predetermined area.

In yet another embodiment, a containment vessel for stowing a high energy density device therein includes a housing, a cover, and a curtain of barrier ribs. The housing includes a base and a sidewall enclosure extending upwardly from the base to define a housing cavity and an opening at a top end thereof. The sidewall enclosure has an array of ventilation holes penetrating from the housing cavity to an exterior surface of the sidewall enclosure. The cover is for covering the top end of the housing cavity. The curtain of barrier ribs is positioned along an inner circumference of the sidewall enclosure.

In yet another embodiment, a method stowing a high energy density device includes providing the containment vessel, using a robot to place a high energy density device in the housing, and using the same or another robot to join the separable collar onto the housing such that the flange is received in the first groove and the first and second discs are received in the second and third grooves.

Other embodiments of the disclosed containment vessel and method for stowing a high energy density device will become apparent from the following detailed description, the accompanying drawings and the appended claims.

DETAILED DESCRIPTION

As used herein, "high energy density device" broadly refers to any energy source that yields, whether by storage or generation, a relatively high amount of energy per unit volume (or mass) of the device. As one non-limiting example, the high energy density device may be an explosive device, such as an improvised explosive device that produces an associated high-pressure wave and fragmentation.

Figure 1:
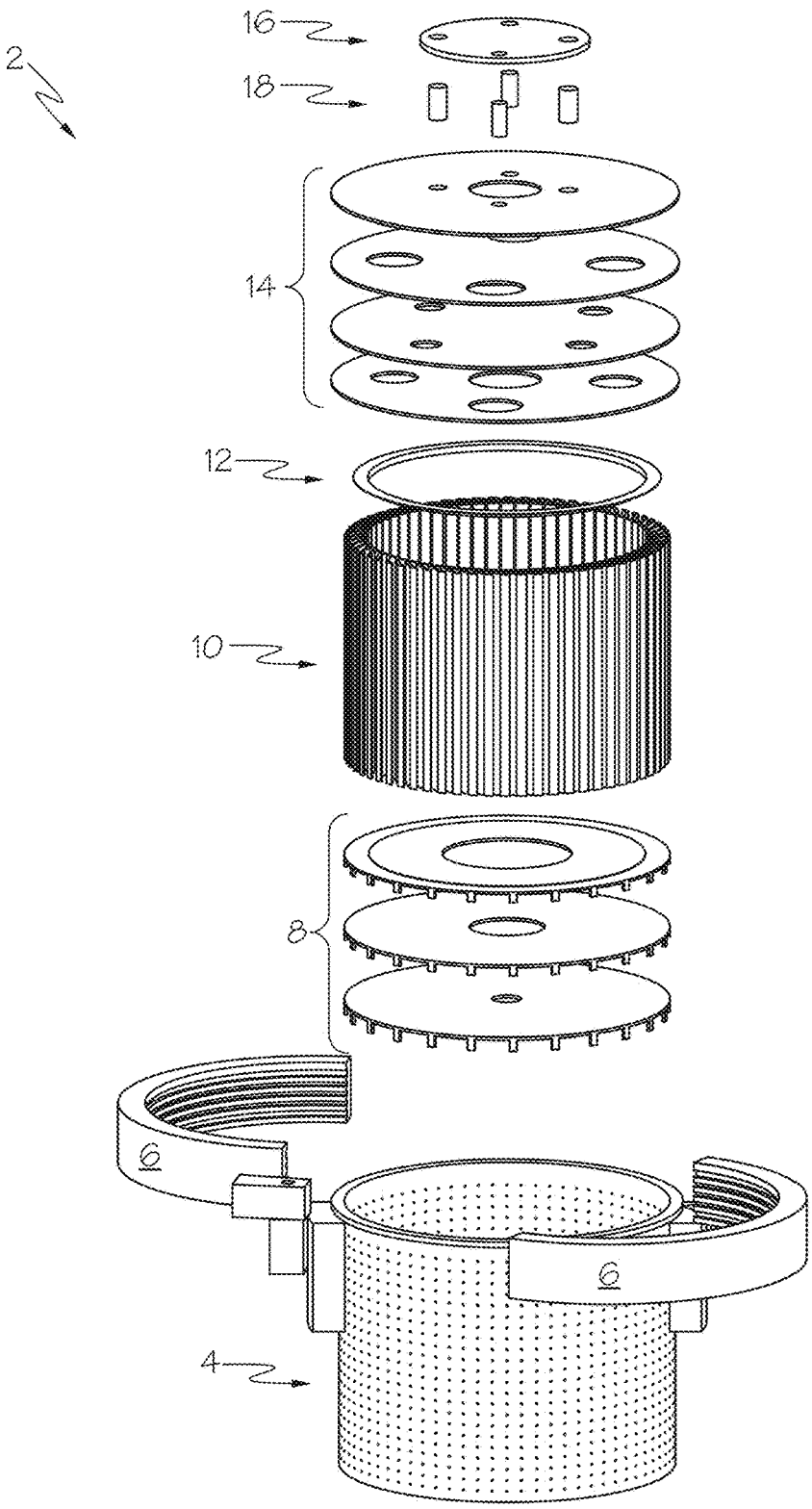
FIG. 1 is an exploded perspective view of one embodiment of a containment vessel for stowing a high energy density device therein.

FIG. 1 is an exploded perspective view of one embodiment of a containment vessel 2 for stowing a high energy density device therein.

As shown in FIG. 1, the containment vessel 2 includes a housing 4 having a housing cavity for stowing a high energy device therein, a separable collar 6 for joining onto the housing, a plurality of plates 8 for positioning at a bottom of housing cavity, a curtain 10 of barrier ribs for positioning around a circumference of the housing cavity, a retainer 12 for retaining a position of the curtain, a plurality of discs 14 for covering the housing cavity, a deflection cap 16 for positioning over the plurality of discs, and a plurality of fasteners 18 for securing the deflection cap to an uppermost of the plurality of discs.

Figure 2:
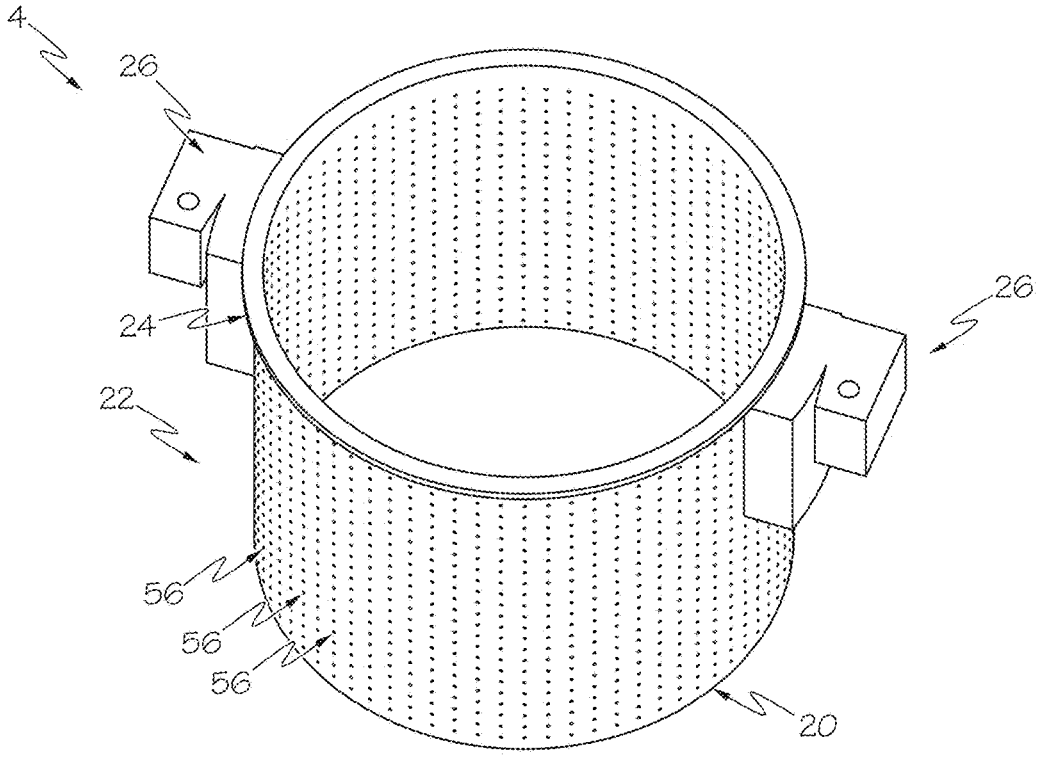
FIG. 2 is a perspective view of a housing of the containment vessel of FIG. 1.

FIG. 2 is a perspective view of a housing of the containment vessel 2 of FIG. 1.

As shown in FIG. 2, the housing 4 includes a base 20 and a sidewall enclosure 22 extending upwardly from the base, a flange 24 extending circumferentially outwardly from the sidewall enclosure, and two hinged connectors 26.

In an aspect, the base is solid throughout with no perforations therethrough. Accordingly, a high pressure within the housing cavity may be directed away from base and towards the sidewall enclosure.

The sidewall enclosure defines a housing cavity and an opening at a top end thereof. In an exemplary aspect, the sidewall enclosure may have the form of a hollow cylinder.

As illustrated, the sidewall enclosure 22 has an array of ventilation holes 56 penetrating from the housing cavity to an exterior surface of the sidewall enclosure. Thus, a high-pressure gas within the housing cavity may be released from the housing through the sidewall enclosure by way of the array of ventilation holes 56 while a fragmentation from a high energy density device is substantially retained in the housing cavity.

In an aspect, a plurality of the ventilation holes 56 are angled upwardly and circumferentially outwardly to induce a downward thrust on the housing when the high pressure within the housing cavity is released. For example, with reference to FIG. 4C, the plurality of ventilation holes may be angled upwardly and circumferentially outwardly at an angle that is between 80 to 85 degrees from the longitudinal axis A of the housing.

In an aspect, the flange 24 is an annular flange extending circumferentially around the sidewall enclosure, and the annular flange has a uniform thickness and width. Alternatively, the flange may include a series of flange segments extending circumferentially around the sidewall enclosure, and a thickness and width of the flange may vary.

In an aspect, the housing 4 is formed from a metal or alloy. For example, the housing may be formed from steel.

Figure 3:
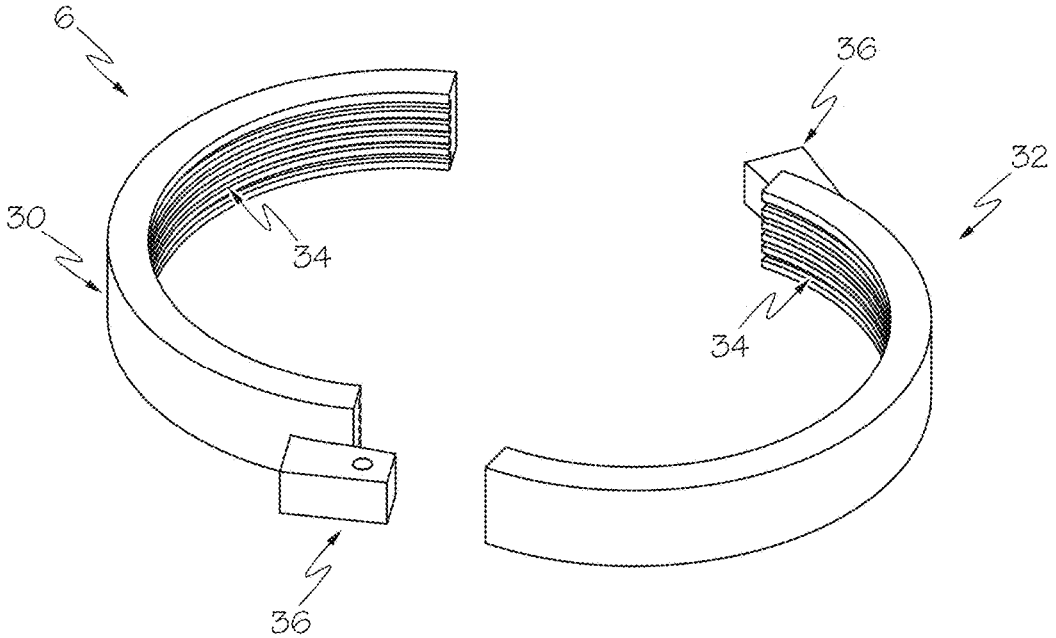
FIG. 3 is a perspective view of a separable collar of the containment vessel of FIG. 1.

FIG. 3 is a perspective view of a separable collar of the containment vessel 2 of FIG. 1.

The separable collar 6 includes a first collar section 30 and a second collar section 32. Each collar section has a plurality of grooves 34 on an inner circumference thereof, and each collar section has a hinged connector 36.

The plurality of grooves 34 include a lowermost groove for receiving the flange of the housing and one groove above the lowermost groove for each disc of the plurality of discs 14 that are to be received by the separable collar. In an aspect, the grooves are annular grooves extending circumferentially around the inner circumference of the separable collar, and the annular grooves have a uniform thickness and width. Alternatively, each groove may include a series of groove segments extending circumferentially around the inner circumference of the separable collar, and a thickness and width of the grooves may vary.

In an aspect, the separable collar 6 is formed from a metal or alloy. For example, the separable collar may be formed from steel.

Figure 4A:
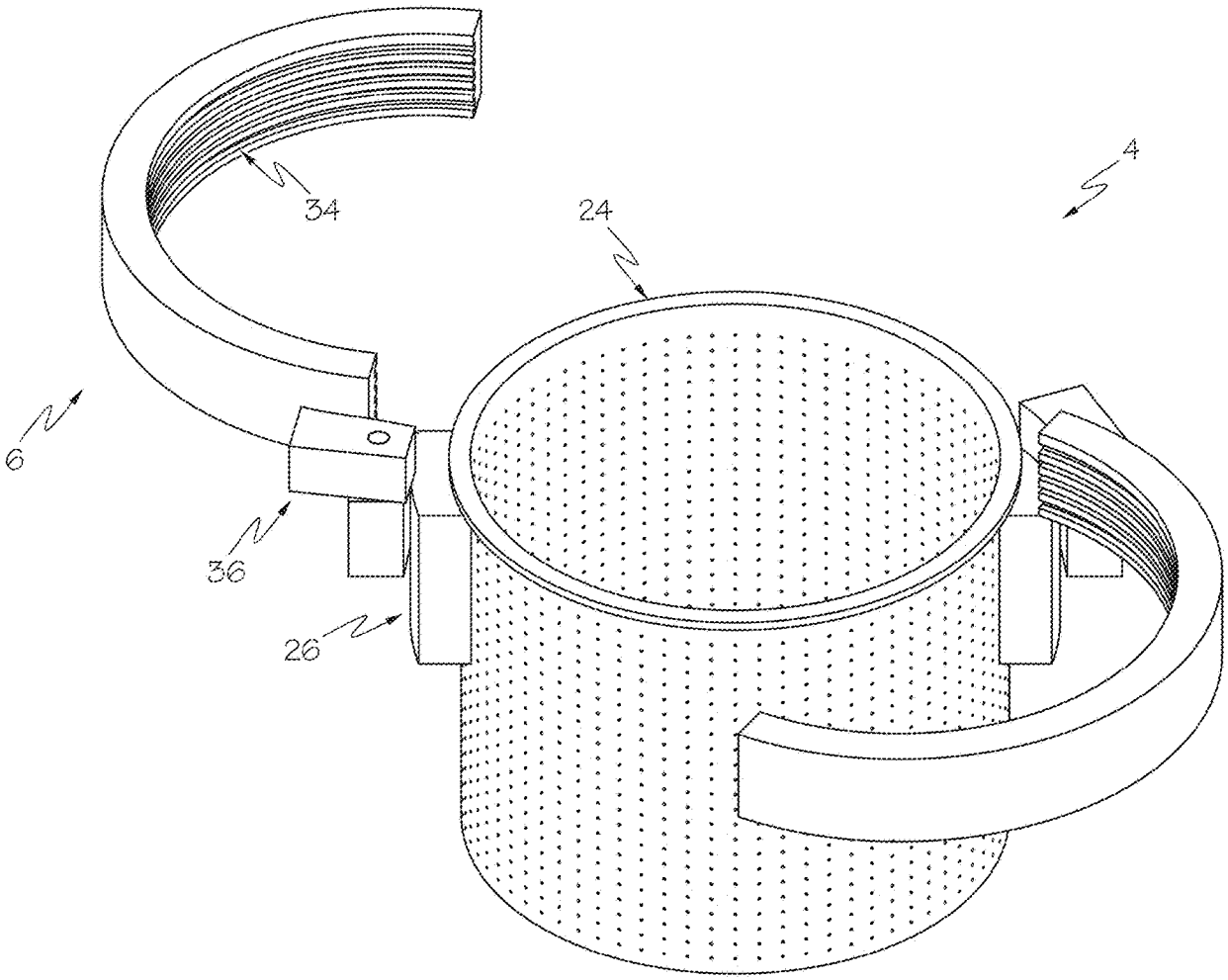
FIGS. 4A and 4B are a perspective views of the housing of FIG. 2 with the separable collar of FIG. 3 in the open and closed positions, respectively.
Figure 4B:
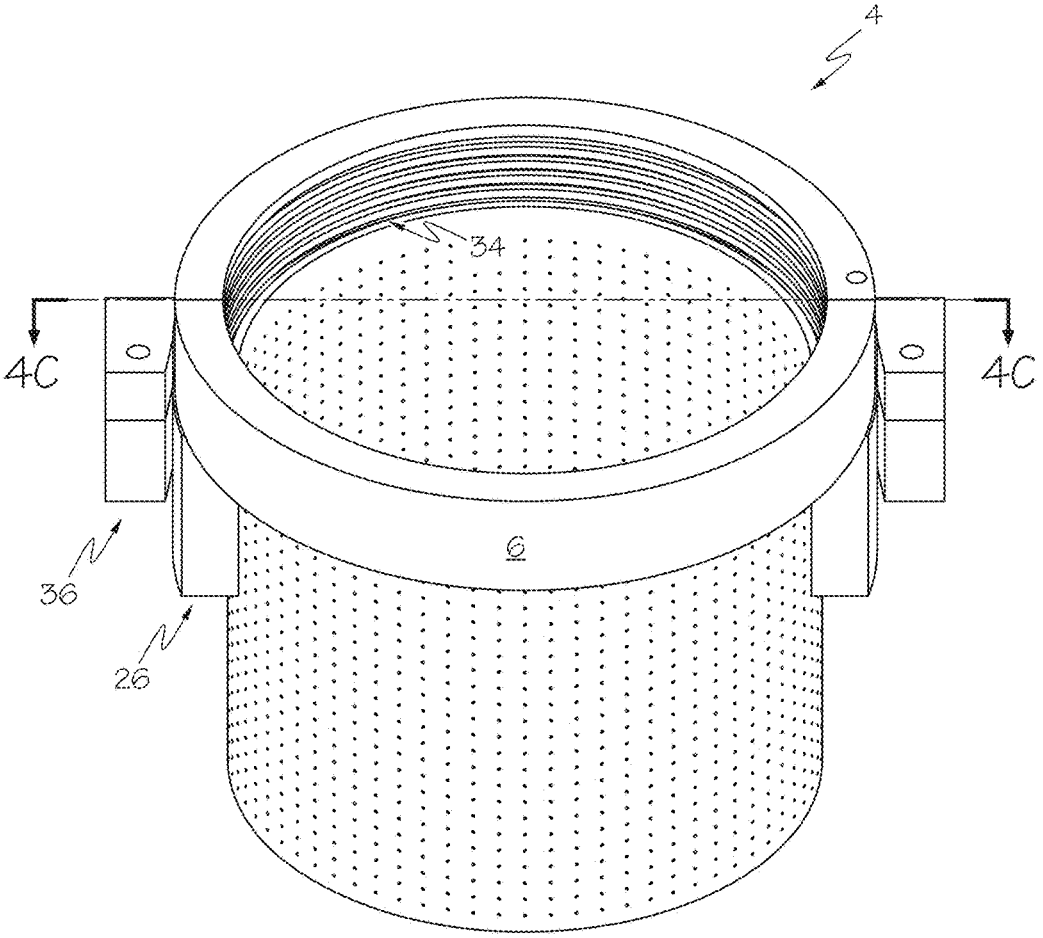
Figure 4C:
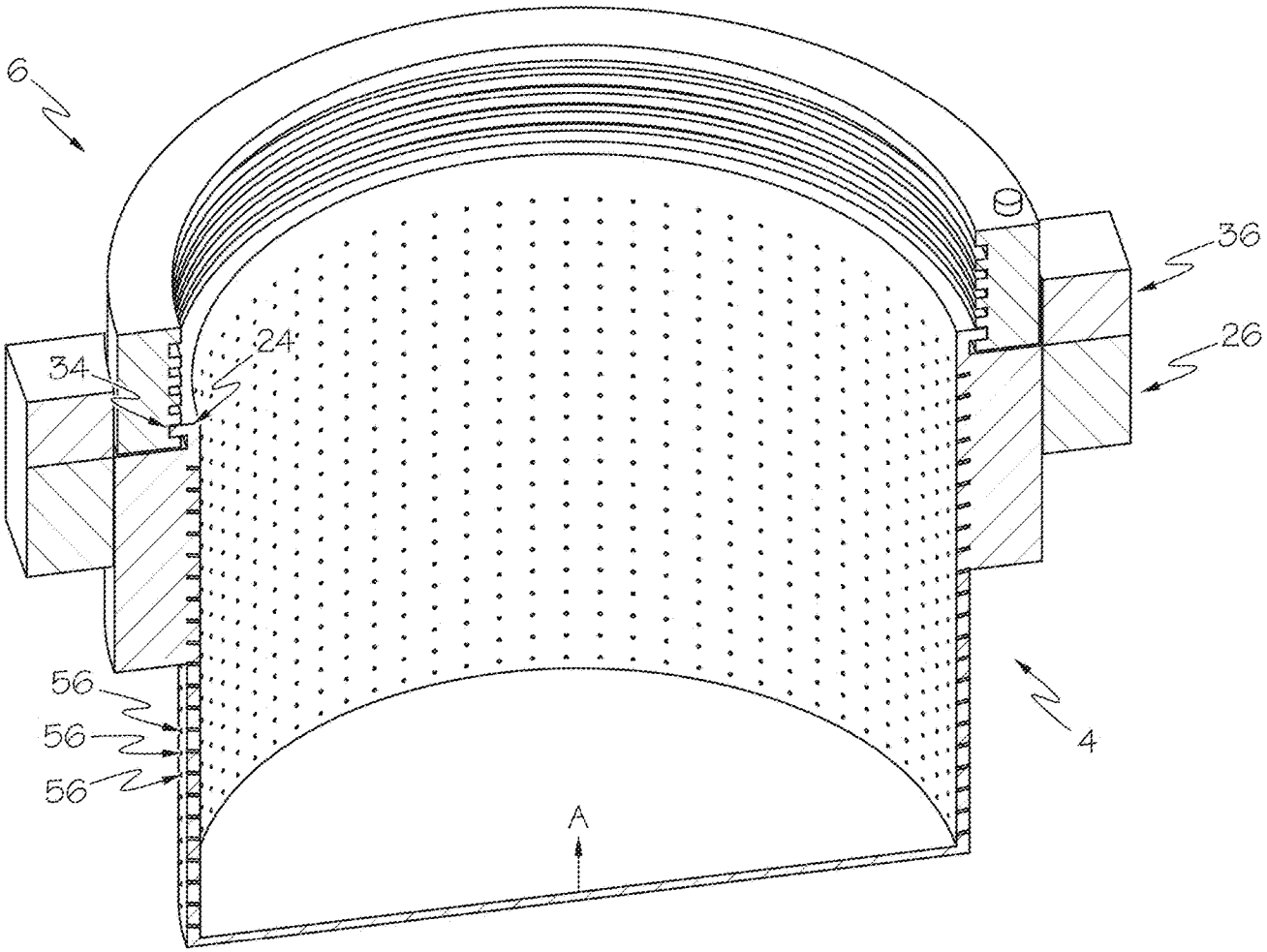
FIG. 4C is a perspective view of the housing and separable collar of FIG. 4B along line 4C-4C.
Figure 6:
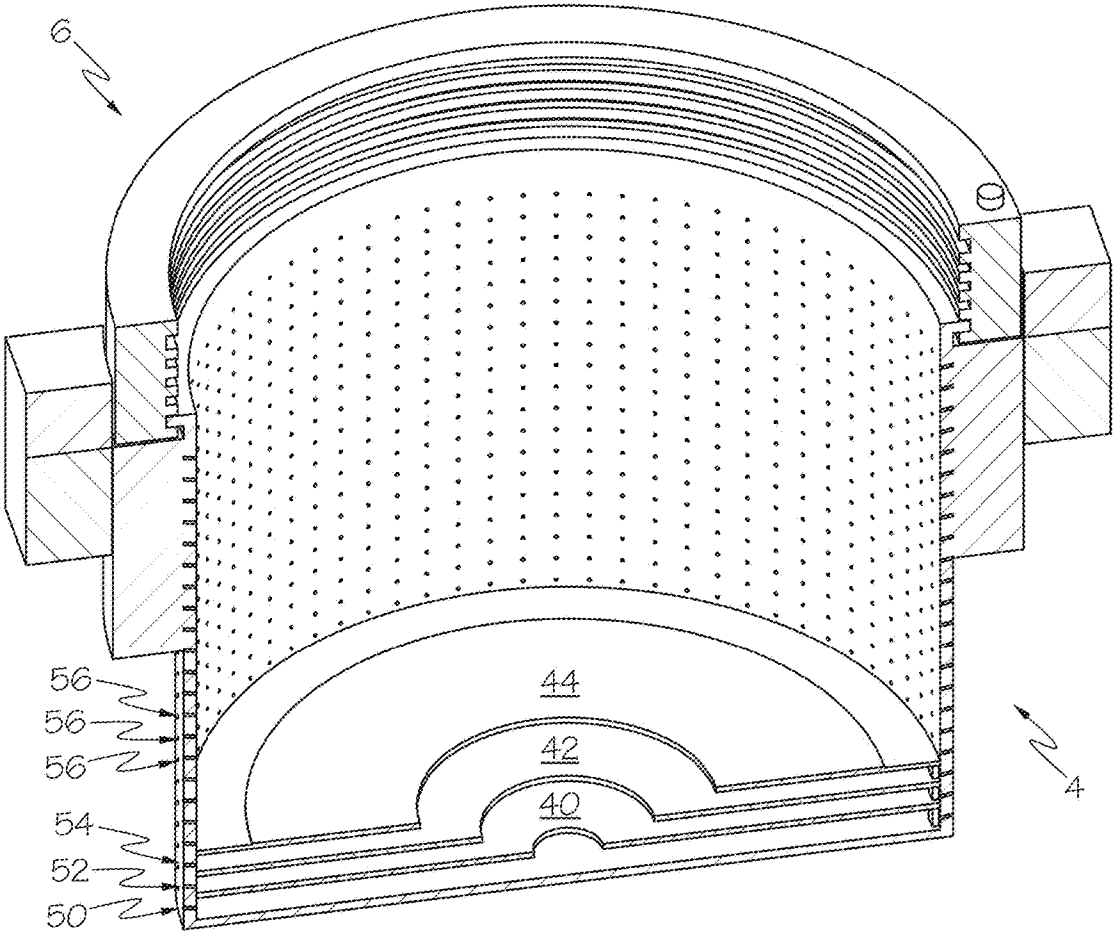
FIG. 6 is a sectional perspective view of the housing of FIG. 2, the separable collar of FIG. 3, and the plurality of plates in stacked configuration of FIG. 5B.
Figure 14:
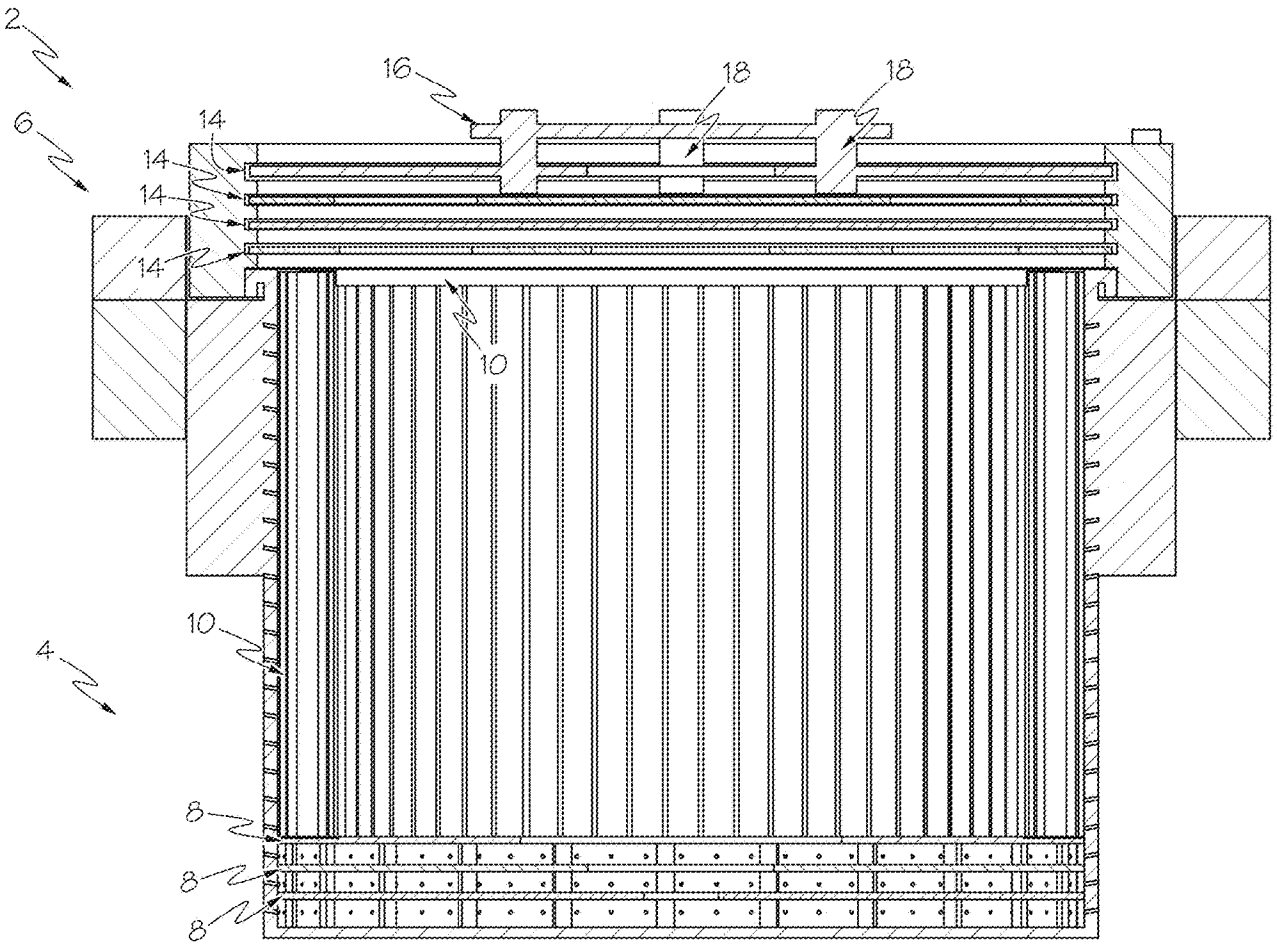
FIG. 14 is an elevational sectional view of the fully assembled containment vessel of FIG. 1.
Figure 15:
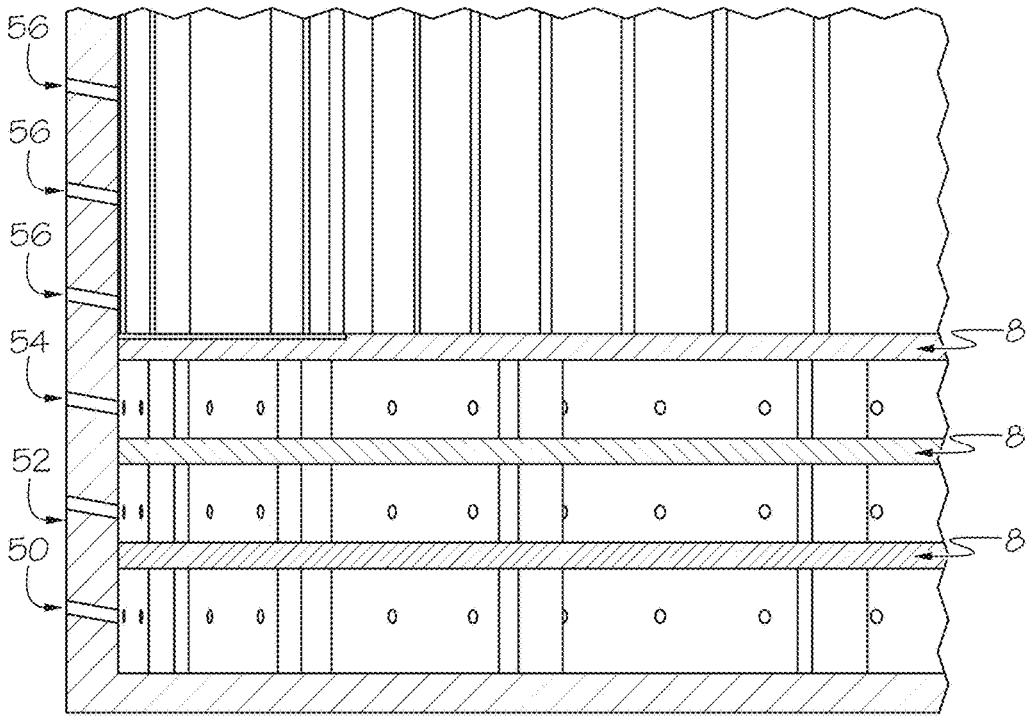
FIG. 15 is a zoomed in elevation sectional showing the lower left portion of FIG. 14.

FIGS. 4A and 4B are a perspective views of the housing of FIG. 2 with the separable collar of FIG. 3 in the open and closed positions, respectively. FIG. 4C is a perspective view of the housing and separable collar of FIG. 4B along line 4C-4C. It is noted that additional section views of FIGS. 6, 14 and 15 are taken along the same line 4C-4C.

As shown in FIG. 4A, the hinged connectors 26 of the housing 4 and the hinged connectors 36 of the separable collar 6 are configured to hingedly engage to permit the first collar section and second collar section to independently pivot relative to the housing between opened and closed positions. In the closed position, the flange 24 of the housing is received in a lowermost groove of the separable collar to retain the separable collar on the housing in the presence of an upward force against the separable collar. The separable collar 6 including the first collar section 30 and second collar section 32 is configured to close around the top of the housing 4 with the housing's annular flange 24 within the lowermost annular groove and at least two discs 14 within the grooves above the lowermost groove, to thereby form a containment vessel for receiving a high energy density device therein, to provide a blast containment device to contain fragments in the event of a detonation of the high energy density device.

Figure 5A:
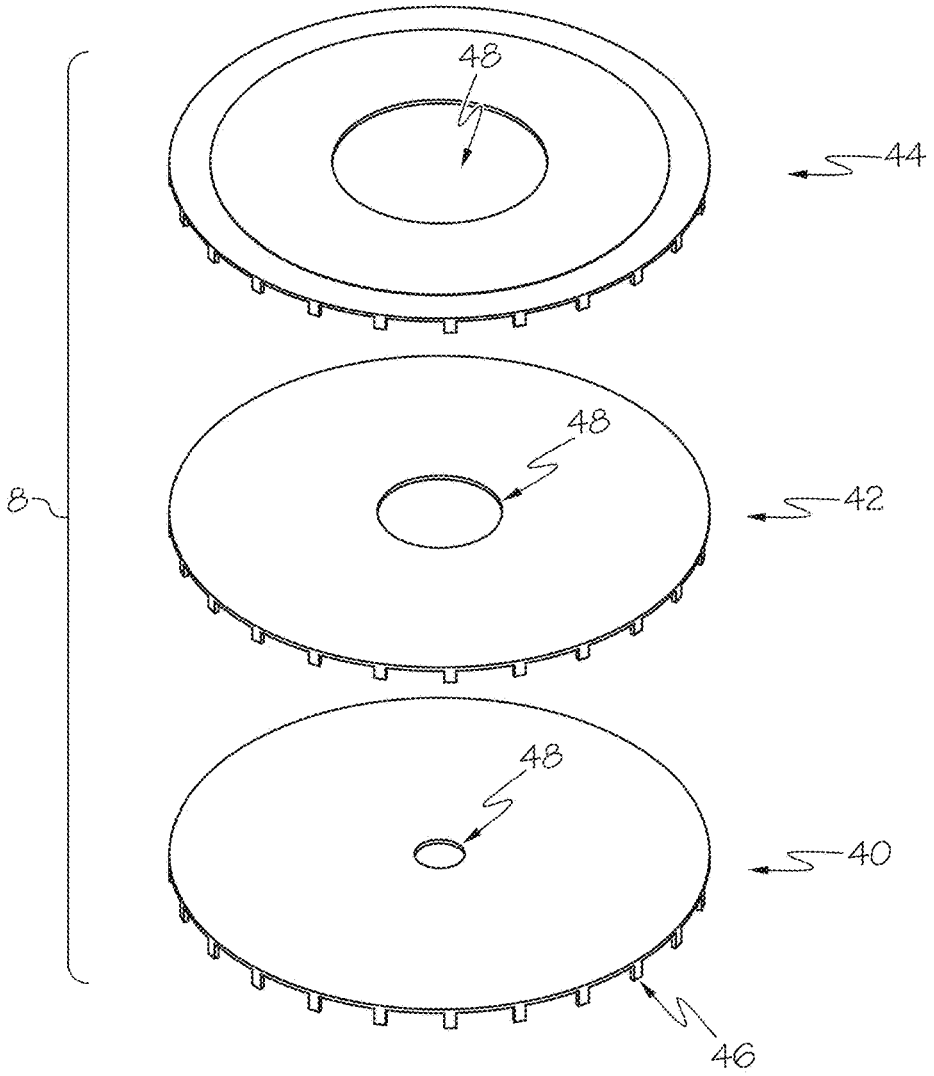
FIGS. 5A and 5B are perspective views of a plurality of plates of the containment vessel of FIG. 1 in separated and stacked configurations, respectively.
Figure 5B:
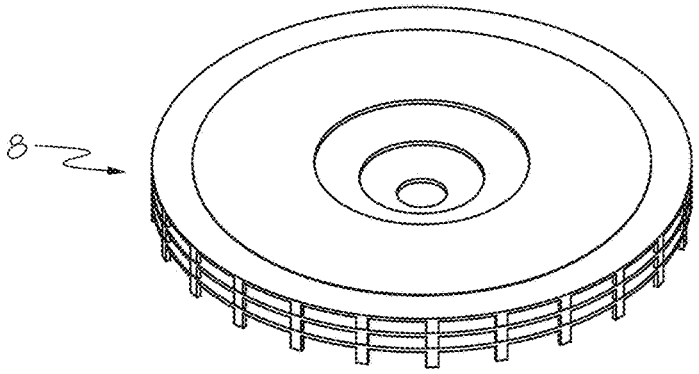

FIGS. 5A and 5B are perspective views of the plurality of plates of the containment vessel 2 of FIG. 1 in separated and stacked configurations, respectively. FIG. 6 is a sectional perspective view of the housing of FIG. 2, the separable collar of FIG. 3, and the plurality of stacked plates of FIG. 5B.

As shown, the plurality of plates 8 includes a first plate 40, a second plate 42, and a third plate 44. In an alternative embodiment, there may be only one plate, only two plates, or more than three plates. The plurality of plates 8 are configured to fit in the stacked configuration within the enclosure sidewall over the base of the housing.

In an aspect, each of the plates 8 has an outer circumference that is slightly less than an inner circumference of the enclosure sidewall of the housing.

As shown, each of the plates 8 has supports 46 for retaining the plates in a spaced relationship over an underlying structure, such as the base of the housing or an underlying plate. The supports may take the form of, for example, a single support structure extending along a periphery of the plate or a plurality of support structures extending along the periphery of the plate. Alternatively, the plates may be retained in a spaced relationship over an underlying structure by, for example, an independent support structure or a support structure associated with the sidewall enclosure. In an aspect, the plates are supported at the peripheral portions and otherwise unsupported to permit the plates to deform in response to a high pressure within the housing cavity.

Accordingly, when the first, second, and third plates are stacked from bottom to top, as shown in FIG. 5B, and placed in the housing as shown in FIG. 6, a first plurality of the ventilation holes 50 are disposed between the first plate and the base of the housing, a second plurality of the ventilation holes 52 are disposed between the second plate and the first plate, and a third plurality of the ventilation holes 54 are disposed between the third plate and the second plate.

As shown, the first, second, and third plates may each include a central opening 48 therein. In an aspect, the central opening of the first plate has a first predetermined area, the central opening of the second plate has a second predetermined area, and the central opening of the third plate has a third predetermined area, in which the second predetermined area is greater than the first predetermined area, and the third predetermined area is greater than the second predetermined area.

Accordingly, when a high pressure is released with the housing cavity, the third plate 44 deforms in response to the high pressure and redirects a portion thereof towards the ventilation holes 56, while permitting a portion of the high pressure to pass through the central opening of the third plate 44. The portion of the high pressure that passes through the central opening of the third plate 44 then deforms the second plate 42 and is directed between the second plate 42 and the third plate 44 towards the ventilation holes 54 while permitting another portion of the high pressure to pass through the central opening of the second plate 42. The portion of the high pressure that passes through the central opening of the second plate 42 then deforms the first plate 40 and is directed between the first plate 40 and the second plate 42 towards the ventilation holes 52 while permitting another portion of the high pressure to pass through the central opening of the first plate 40. The portion of the high pressure that passes through the central opening of the first plate 40 is directed between the first plate 40 and the base of the housing towards the ventilation holes 50. By this arrangement of plates and central openings, the high pressure applied to the base of the housing may be suppressed by absorbing portions of the high pressure by each of the plates. Also, an impact on the base from fragmentation of a high energy density device may be absorbed by the plates. In an aspect, plates damaged by any fragmentation could be replaced and the containment device could be reused.

In an aspect, the plurality of plates are formed from a metal or alloy. For example, the plurality of plates may be formed from steel.

Figure 7:
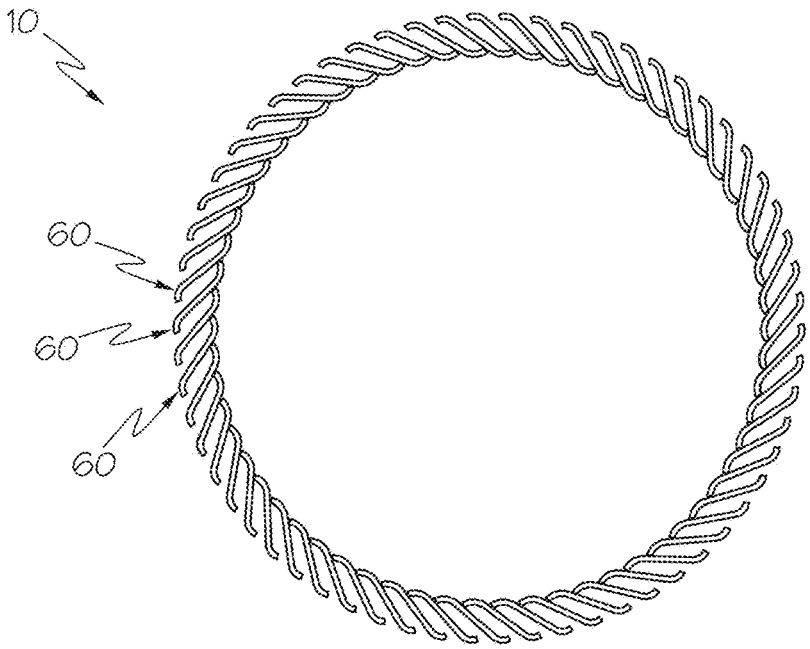
FIG. 7 is a perspective view of a curtain of the containment vessel of FIG. 1.
Figure 8A:
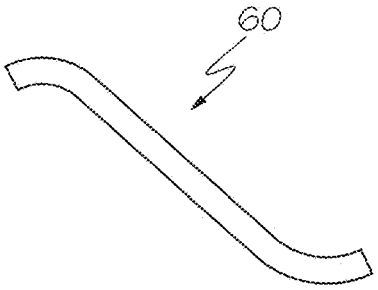
FIGS. 8A and 8B are top and perspective views of a barrier rib of the curtain of FIG. 7.
Figure 8B:
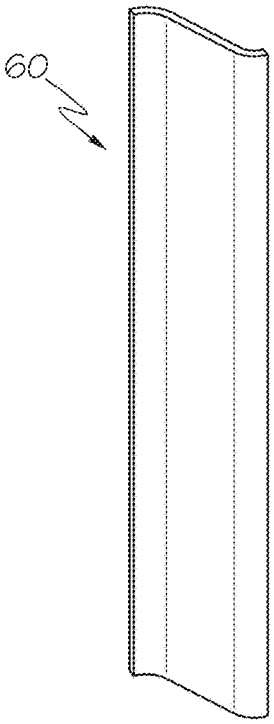
Figure 9A:
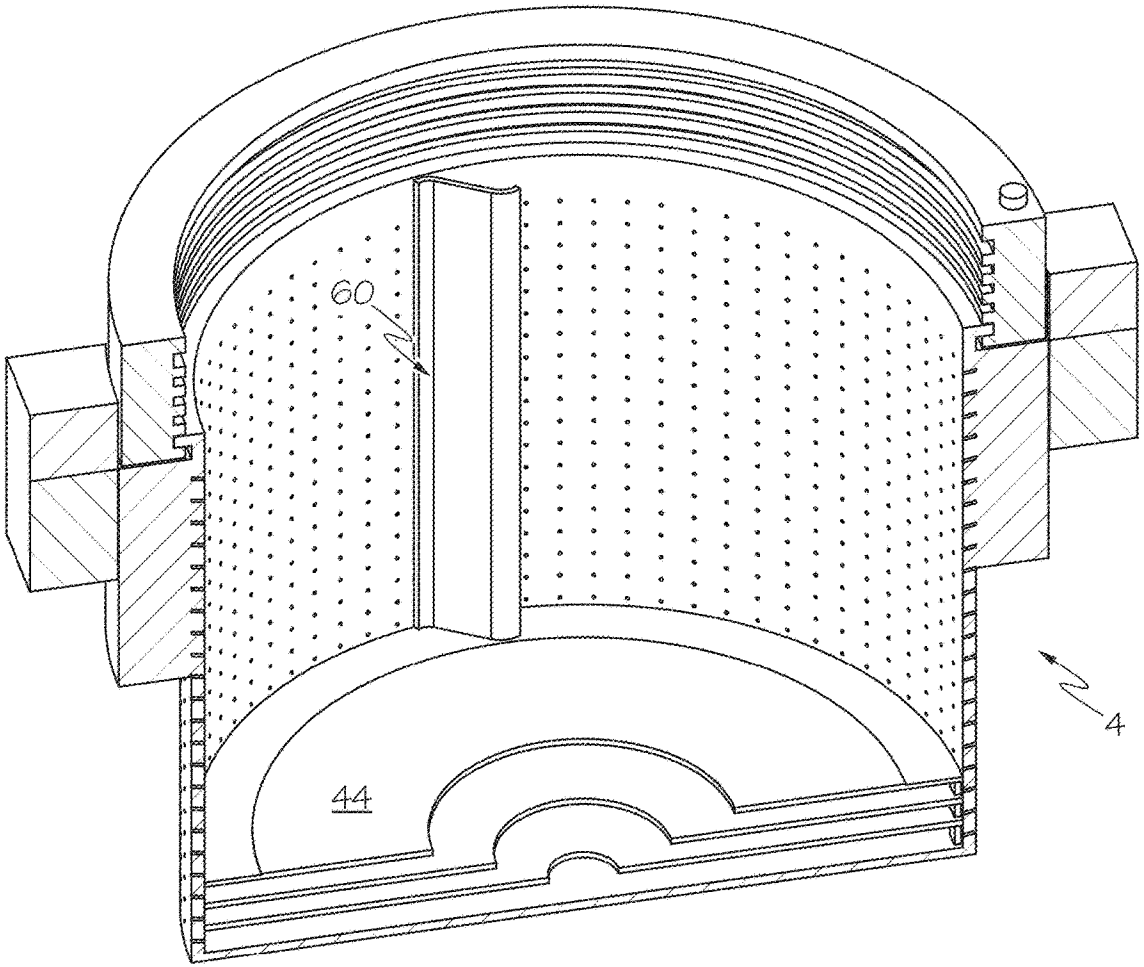
FIGS. 9A to 9C are perspective views showing a process of assembly of the barrier ribs of FIGS. 8A and 8B in the containment vessel of FIG. 6.
Figure 9B:
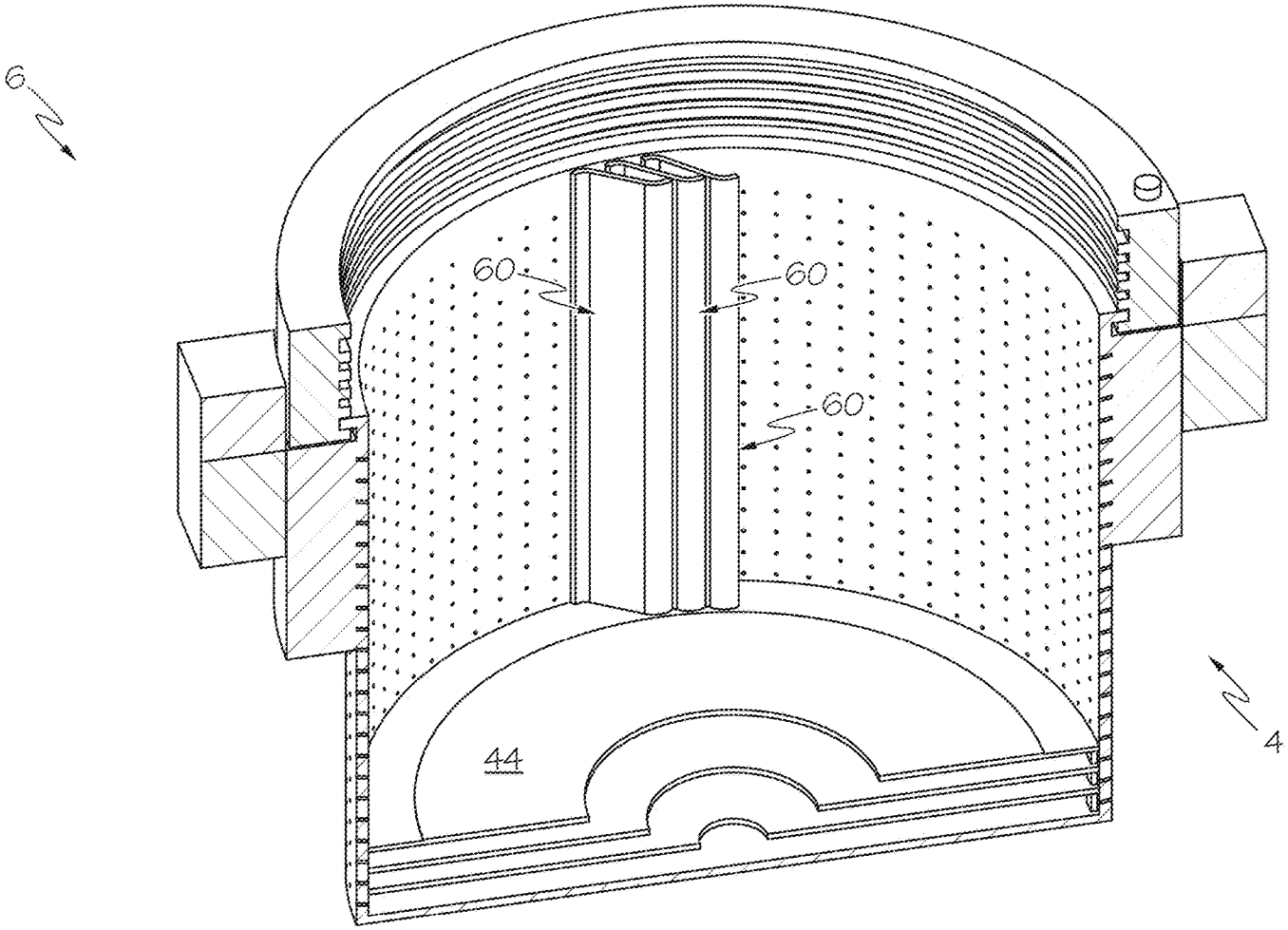
Figure 9C:
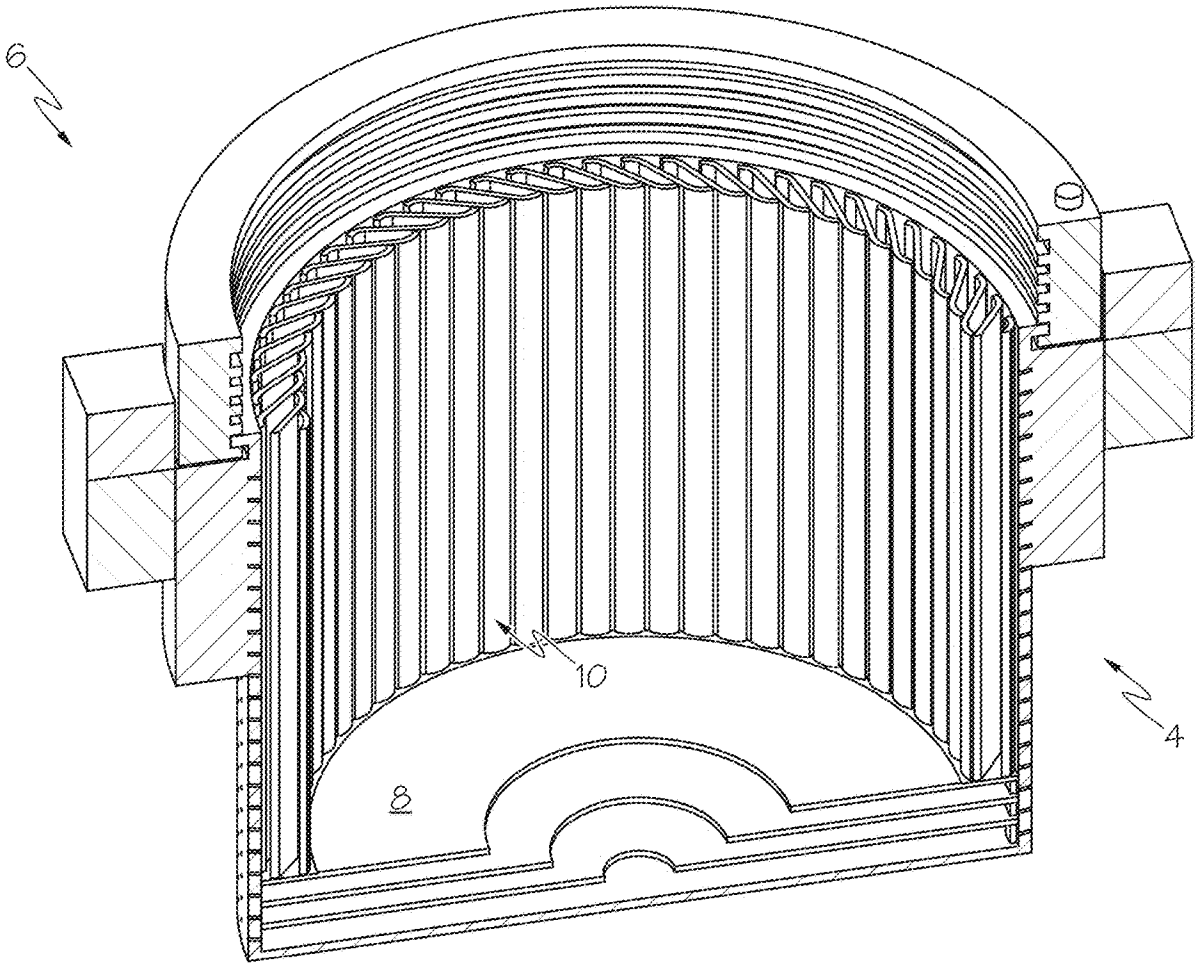

FIG. 7 is a perspective view of a curtain of the containment vessel 2 of FIG. 1. FIGS. 8A and 8B are top and perspective views of a barrier rib of the curtain of FIG. 7. FIGS. 9A to 9C show a process of assembly of the barrier ribs of FIGS. 8A and 8B in the containment vessel of FIG. 6.

With reference to FIG. 7, the curtain 10 is formed from a plurality of barrier ribs 60. In an aspect, the curtain is positioned in an overlapping relationship to form a periphery around the cavity of the housing.

With reference to FIGS. 8A and 8B, barrier ribs 60 may be in the form of overlapping curved plates, such as the illustrated S-shaped overlapping curved plates. In an alternative embodiment, the barrier ribs 60 may be formed into a non-plate shape having a non-uniform thickness.

With reference to FIGS. 9A to 9C, the curtain of barrier ribs is assembled by positioning each of the barrier ribs 60 along an inner circumference of the sidewall enclosure 22. In an alternative embodiment, the barrier ribs 60 could be pre-assembled into a curtain of barrier ribs and then lowered into the housing cavity.

In an aspect, an uppermost plate of the plurality of plates 8 includes a groove form on an upper surface thereof. Accordingly, bottom portions of the barrier ribs are retained within the groove to maintain their desired positions within the housing.

The curtain of barrier ribs functions to suppress an effect of high pressure and fragmentation from a high energy density device in the cavity of the housing. In an aspect, the curtain of barrier ribs is circumferentially outwardly expendable by a deformation of the barrier ribs. Thus, the curtain of barrier ribs suppresses an effect of high pressure by deforming, elastically and/or inelastically, in response to a high pressure released within the housing cavity. Also, the curtain of barrier ribs suppresses an effect of fragmentation on the housing by absorbing an impact from a fragmentation of a high energy density device. In an aspect, barrier ribs damaged by any fragmentation could be replaced and the containment device could be reused.

Figure 10:
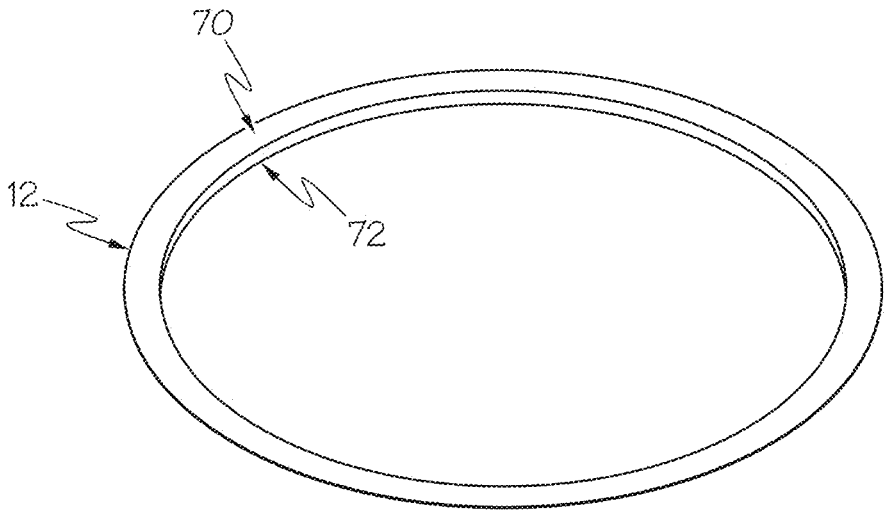
FIG. 10 is a perspective view of a retainer of the containment vessel of FIG. 1.
Figure 11:
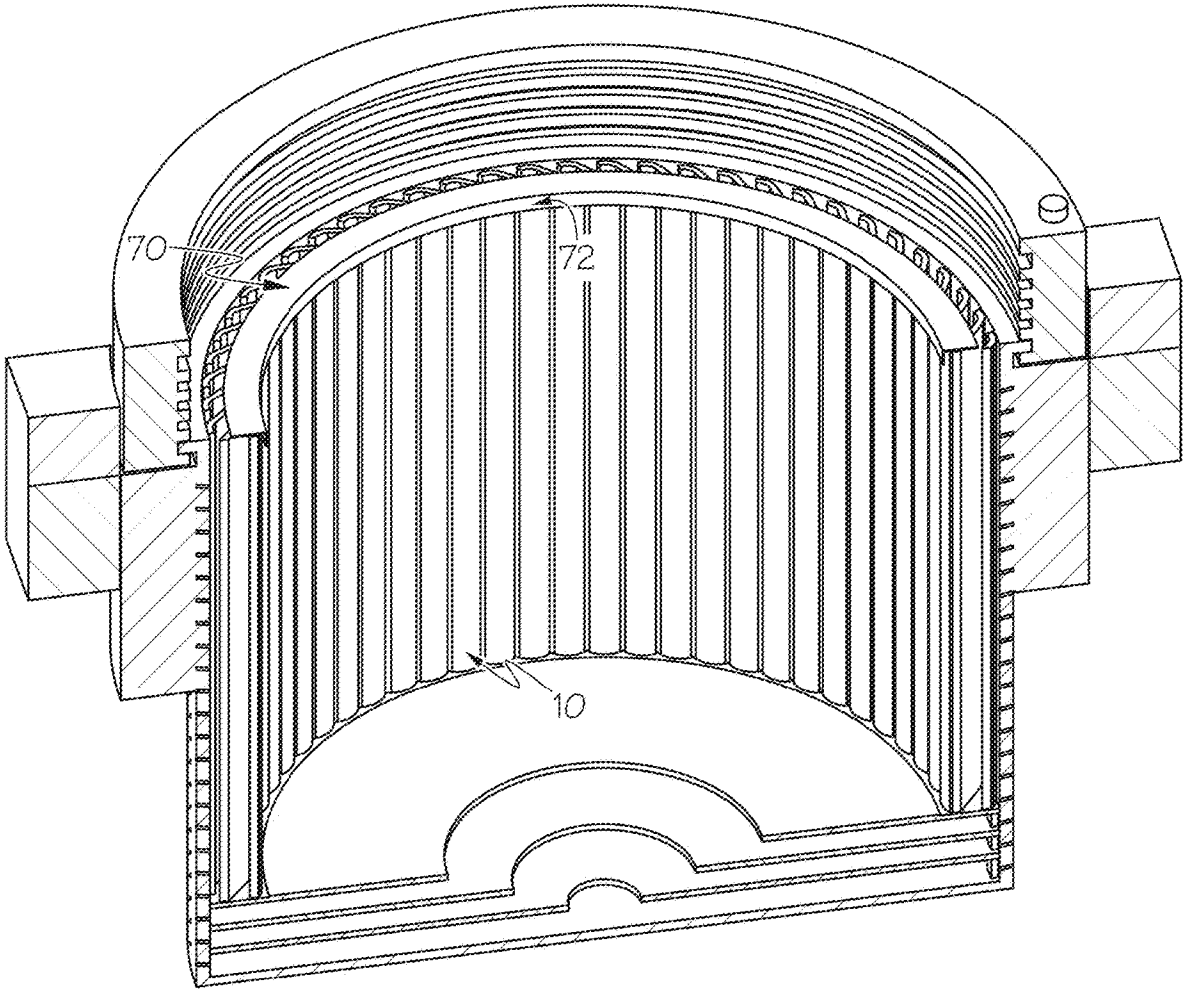
FIG. 11 is a perspective view of the retainer of FIG. 10 on the containment vessel of FIG. 9C.

FIG. 10 is a perspective view of a retainer of the containment vessel 2 of FIG. 1. FIG. 11 is a perspective view of the retainer of FIG. 10 on the containment vessel of FIG. 9C.

With reference to FIG. 10, in one embodiment, the retainer 12 is in the form a ring and includes a horizontal flange 70 and vertical flange 72. With reference to FIG. 10, the horizontal flange 70 rests on a top of the curtain 10 of barrier ribs, and the vertical flange extends downwardly to prevent the barrier ribs from falling towards an interior of the housing cavity.

Figure 12:
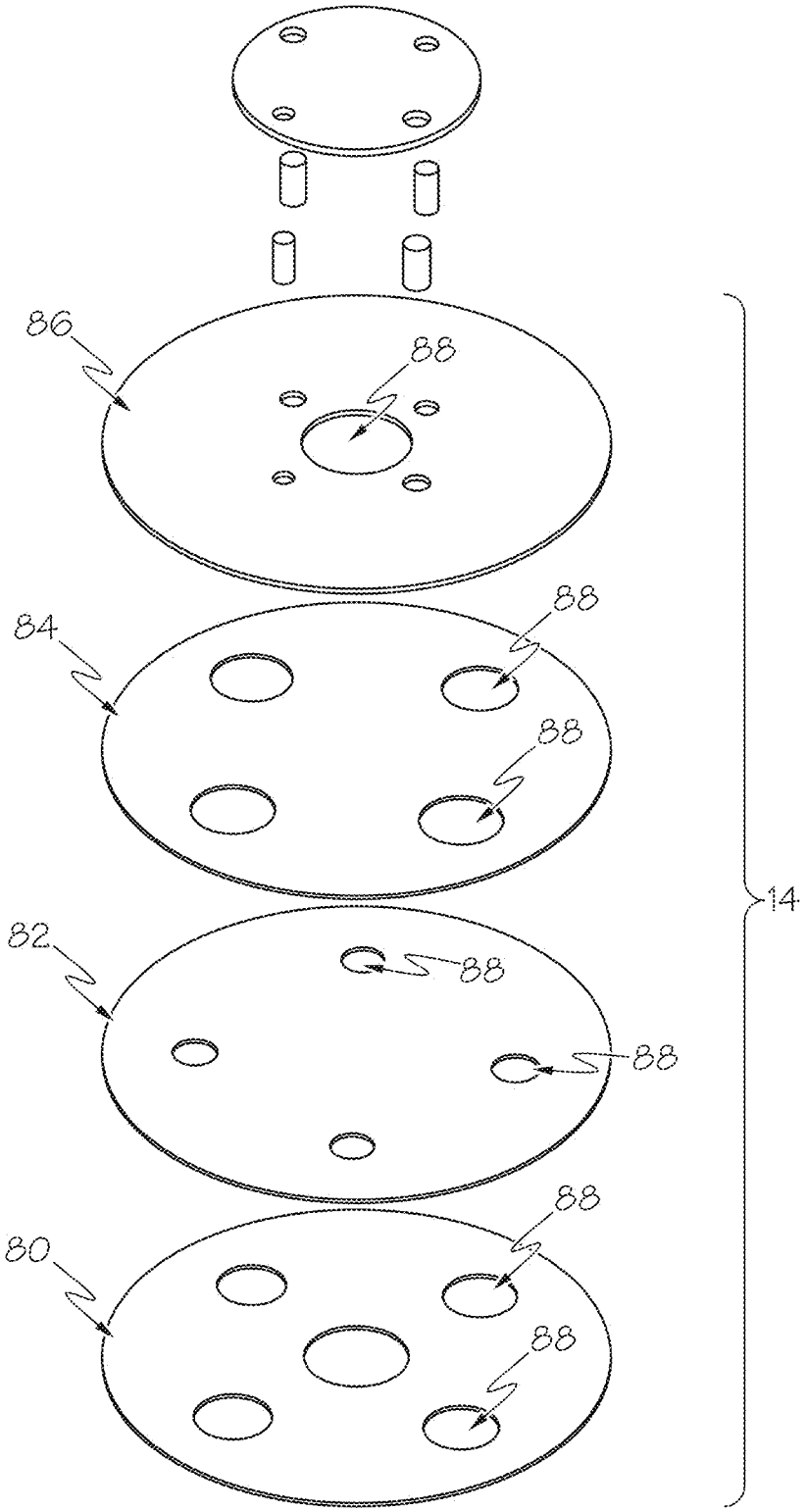
FIG. 12 is a perspective view of a plurality of discs of the containment vessel of FIG. 1 with a deflection cap fastened to an uppermost plate.
Figure 13A:
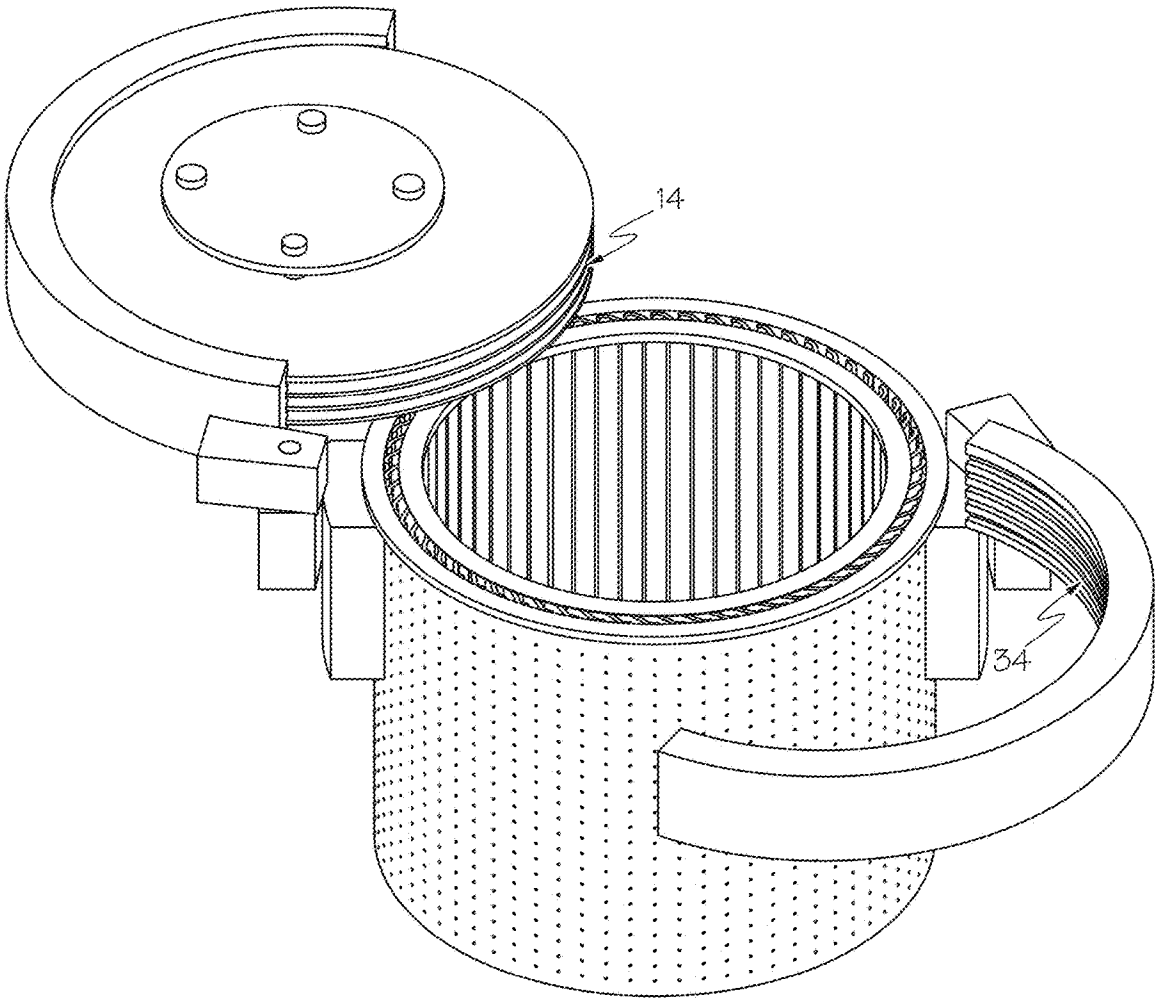
FIGS. 13A and 13B are perspective views of the plurality of discs and the containment vessel as shown in FIG. 11, in opened and closed configurations.
Figure 13B:
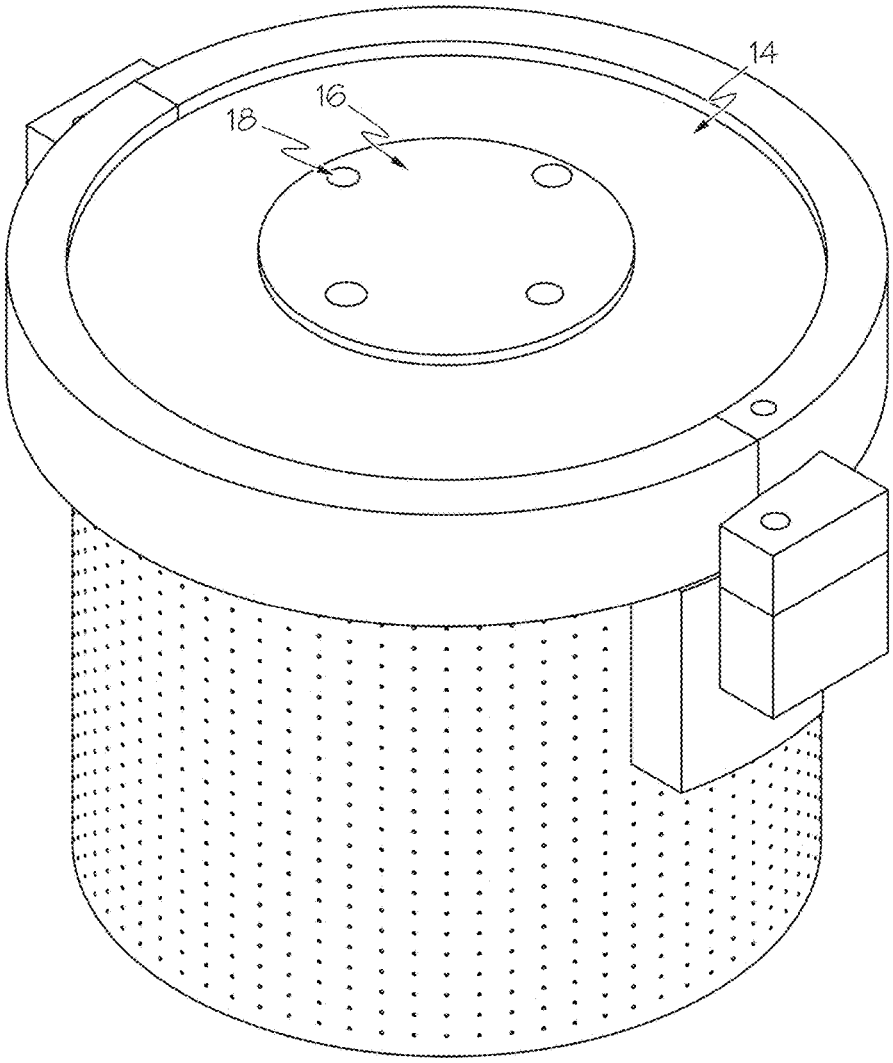

FIG. 12 is a perspective view of a plurality of discs of the containment vessel 2 of FIG. 1 with a deflection cap fastened to an uppermost plate. FIGS. 13A and 13B are perspective views of the plurality of discs and the containment vessel as shown in FIG. 11, in opened and closed configurations. FIG. 14 is an elevational sectional view of the fully assembled containment vessel 2 of FIG. 1. FIG. 15 is a zoomed in elevation sectional showing the lower left portion of FIG. 14.

With reference to FIG. 12, the plurality of discs 14 includes a first disc 80, a second disc 82, a third disc 84, and a fourth disc 86. In an alternative embodiment, there may be only one two discs, only three discs, or more than four discs.

In an aspect, the plurality of discs each define one or more apertures 88 therein, which may be included a variety of shapes and sizes. In an aspect, each aperture of the plurality of discs is overlapped by a non-apertured region of another of the plurality of discs. By this arrangement of apertures and non-apertured regions, when the discs are positioned in a stacked arrangement, a high-pressure gas within the housing cavity may be released from the housing through the apertures in the plurality of discs, and the gas must follow a non-straight (torturous) path to exit the housing. Thus, an effect of fragmentation from a high energy density device is substantially retained in the housing cavity. In an aspect, any discs damaged by any fragmentation could be replaced and the containment device could be reused.

With reference to FIGS. 13A and 13B, each of the discs are supported at their peripheral portions by grooves 34 of the separable collar. In an aspect, each of the discs are supported at their peripheries and are otherwise unsupported to permit the discs to deform in response to a high pressure within the housing cavity.

As shown, the containment vessel may further include a deflection cap 16 secured over the one or more apertures of the uppermost of the plurality of discs by one or more fasteners 18. As illustrated, the fourth disc 86 includes only one central aperture 88 underneath the deflection cap 16. By way of this arrangement of the final aperture 88 and the deflection cap 16, the high pressure exits the housing in an outward direction to avoid inducing a thrust on the containment vessel. Further, any fragmentation that remains after passing through the discs contacts the deflection cap upon exiting the final aperture.

With reference to FIGS. 13A and 13B, the plurality of discs 14 may be held in one of the sections of the separable collar. Thus, the containment vessel can be pre-assembled to include all components, including the discs, prior to attempting to stow a high energy device in the containment vessel. Once the high energy device is stowed in the containment vessel, only the sections of the separable collar are joined to secure the containment vessel. Thus, the containment vessel is particularly suitable for being handled by one or more robotic devices, in which a robot is used to place a high energy density device in the housing and the same or another robot is used to join the separable collar. Upon joining the separable collar, the flange is received in the first groove and the plurality of discs are received in the additional corresponding grooves.

In an aspect, one section of the separable collar that is pre-assembled with the discs is maintained in an open position, and the other section of the separable collar is closed onto the housing in the closed position. Thus, once the high energy device is stowed in the containment vessel, only the open section of the separable collar pre-assembled with the discs is closed to secure the containment vessel.

Aspects of the present description provide a containment vessel comprising a perforated containment vessel encapsulated at an open end with a hinged lid, wherein, the blast containment device comprises a plurality of suppressor features to contain fragments and or control over-pressure (e.g., in the event of a detonation of a high energy density device).

Aspects of the present description provide for compact containment vessel having suppressive features capable of capturing shrapnel and other fragmentation while maintaining suitable pressures during a blast.

Aspects of the present description provide for a containment vessel having a perforated housing having a longitudinal axis and an aperture at one end and configured to engage a separable hinged cap to cover the aperture at the one end.

Aspects of the present description provide for a hinged cap coupling to a plurality of discs, the discs positioned away from each other having relative spacing such that a gap exists between each of the discs, and the discs each have at least one aperture and wherein the aperture of each disc is positioned such that the openings of the apertures do not intersect about their respective peripheral edges.

Aspects of the present description provide for the perforated housing comprising a plurality of apertures each having an angled position such that the angle is 70 to 89 degrees (e.g., 80 to 85 degrees) from the longitudinal axis.

Aspects of the present description provide for a barrier in the form of a spring shield formed using aligned spring ribs such that the ribs surround an inner surface of the housing, and wherein the springs are supported and secured by a plurality of lower plates, the lower plates having standoff supports to position the lower plates away from the base of the housing and each having an aperture at the center of each plate.

Figure 16:
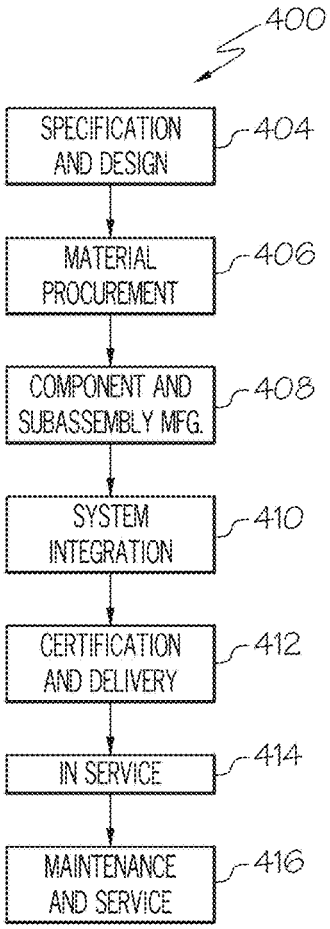
FIG. 16 is a flow diagram of an aircraft manufacturing and service methodology.
Figure 17:
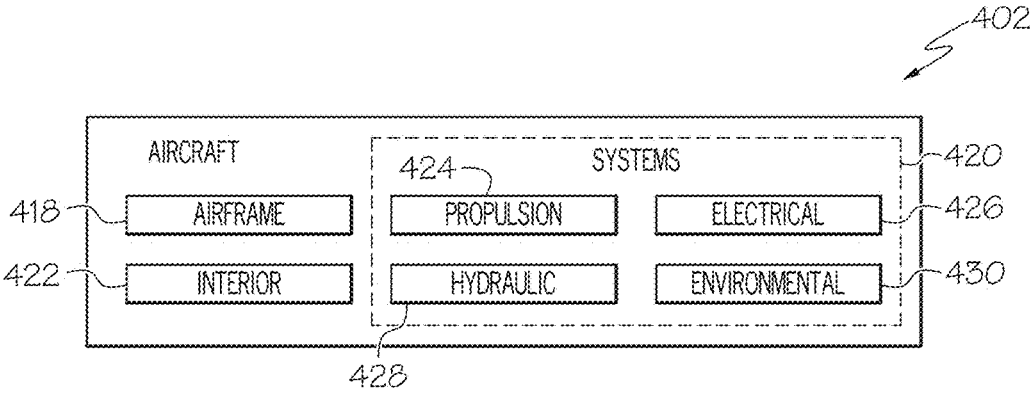
FIG. 17 is a block diagram of an aircraft.

Examples of the disclosed containment vessel 2 and method for stowing a high energy device may be described in the context of an aircraft manufacturing and service method 400, as shown in FIG. 16, and an aircraft 402, as shown in FIG. 17. During pre-production, the aircraft manufacturing and service method 400 may include specification and design 404 of the aircraft 402 and material procurement 406. During production, component/subassembly manufacturing 408 and system integration 410 of the aircraft 402 takes place. Thereafter, the aircraft 402 may go through certification and delivery 412 in order to be placed in service 414. While in service by a customer, the aircraft 402 is scheduled for routine maintenance and service 416, which may also include modification, reconfiguration, refurbishment and the like.

Each of the processes of method 400 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 17, the aircraft 402 produced by example method 400 may include an airframe 418 with a plurality of systems 420 and an interior 422. Examples of the plurality of systems 420 may include one or more of a propulsion system 424, an electrical system 426, a hydraulic system 428, and an environmental system 430. Any number of other systems may be included. The disclosed containment vessel 2 may be incorporated into various systems 420 of the aircraft 402, such as the electrical system 426 and/or the environmental system 430.

The disclosed containment vessel 2 and method for stowing a high energy device may be employed during any one or more of the stages of the aircraft manufacturing and service method 400. For example, components or subassemblies corresponding to component/subassembly manufacturing 408, system integration 410, and or maintenance and service 416 may be fabricated or manufactured using the disclosed containment vessel. Also, one or more apparatus examples, method examples, or a combination thereof may be utilized during component/subassembly manufacturing 408 and/or system integration 410, for example, by substantially expediting assembly of or reducing the cost of an aircraft 402, such as the airframe 418 and/or the interior 422. Similarly, one or more of system examples, method examples, or a combination thereof may be utilized while the aircraft 402 is in service, for example and without limitation, to maintenance and service 416.

The disclosed containment vessel and method for stowing a high energy device are described in the context of an aircraft; however, one of ordinary skill in the art will readily recognize that the disclosed service system may be utilized for a variety of different components for a variety of different types of vehicles. As one example, implementations of the embodiments described herein may be implemented in any type of vehicle including, e.g., helicopters, passenger ships, automobiles and the like. As another example, the disclosed containment vessel and method may be used for stowing a high energy device, such as an explosive device.

Although various embodiments of the disclosed containment vessel and method for stowing a high energy density device have been shown and described, modifications may occur to those skilled in the art upon reading the specification. The present application includes such modifications and is limited only by the scope of the claims.

What is claimed is:

1. A containment vessel for stowing a high energy density device therein, the containment vessel comprising:

a housing including:

a base;

a sidewall enclosure extending upwardly from the base, the sidewall enclosure defining a housing cavity and an opening at a top end thereof; and a flange extending circumferentially outwardly from the sidewall enclosure;

a plurality of discs; and a separable collar having first, second, and third grooves on an inner circumference of the separable collar, wherein the first groove is configured to receive the flange of the housing, and wherein the second and third grooves are configured to receive first and second of the plurality of discs.

2. The containment vessel of claim 1 wherein the plurality of discs each define one or more apertures therein, wherein each aperture of the plurality of discs is overlapped by a non-apertured region of another of the plurality of discs.

3. The containment vessel of claim 2, further comprising a deflection cap secured over the one or more apertures of the uppermost of the plurality of discs.

4. The containment vessel of claim 1 wherein the separable collar includes first and second separable portions, at least one of the first and second separable portions being hingedly connected to the housing.

5. The containment vessel of claim 1 wherein the plurality of discs includes a third disc, and wherein the inner circumference of the separable collar has a fourth groove configure to receive the third disc.

6. The containment vessel of claim 5 wherein the plurality of discs includes a fourth disc, and wherein the inner circumference of the separable collar has a fifth groove configure to receive the fourth disc.

7. A containment vessel for stowing a high energy density device therein, the containment vessel comprising:

a housing including:

a base; and a sidewall enclosure extending upwardly from the base to define a housing cavity and an opening at a top end thereof, the sidewall enclosure having an array of ventilation holes penetrating from the housing cavity to an exterior surface of the sidewall enclosure;

a cover for covering the top end of the housing cavity; and at least a first plate retained in a spaced relationship over the base of the housing such that a first plurality of the ventilation holes are disposed between the base of the housing and the first plate, wherein the first plate includes a central opening having a first predetermined area.

8. The containment vessel of claim 7 wherein a plurality of the ventilation holes are angled upwardly and circumferentially outwardly.

9. The containment vessel of claim 8, wherein the plurality of ventilation holes are angled upwardly and circumferentially outwardly at an angle that is between 80 to 85 degrees from a longitudinal axis of the housing.

10. The containment vessel of claim 7 further comprising a second plate retained in a spaced relationship over the first plate such that a second plurality of the ventilation holes are disposed between the first plate and the second plate, wherein the second plate includes a central opening having a second predetermined area, wherein the second predetermined area is greater than the first predetermined area.

11. The containment vessel of claim 10 further comprising a third plate retained in a spaced relationship over the second plate such that a third plurality of the ventilation holes are disposed between the second plate and the third plate, wherein the third plate includes a central opening having a third predetermined area, wherein the third predetermined area is greater than the second predetermined area.

12. The containment vessel of claim 7 further comprising a curtain of barrier ribs positioned along an inner circumference of the sidewall enclosure over the first plate.

13. The containment vessel of claim 12 wherein an upper surface of an uppermost of the first plate includes at least one groove formed therein, and wherein the barrier ribs are retained in the groove.

14. A containment vessel for stowing a high energy density device therein, the containment vessel comprising:

a housing including:

a base; and a sidewall enclosure extending upwardly from the base to define a housing cavity and an opening at a top end thereof, the sidewall enclosure having an array of ventilation holes penetrating from the housing cavity to an exterior surface of the sidewall enclosure;

a cover for covering the top end of the housing cavity; and a curtain of barrier ribs positioned along an inner circumference of the sidewall enclosure.

15. The containment vessel of claim 14 wherein a plurality of the ventilation holes are angled upwardly and circumferentially outwardly.

16. The containment vessel of claim 15, wherein the plurality of ventilation holes are angled upwardly and circumferentially outwardly at an angle that is between 80 to 85 degrees from the longitudinal axis of the housing.

17. The containment vessel of claim 14 wherein the curtain of barrier ribs is circumferentially outwardly expendable by a deformation of the barrier ribs.

18. The containment vessel of claim 14 wherein the barrier ribs are in the form of overlapping curved plates.

19. The containment vessel of claim 14 further comprising a retainer on the curtain of barrier ribs, and wherein the barrier ribs are retained in their positions by the retainer.

20. A method for stowing a high energy density device, the method comprising:

providing the containment vessel of claim 1;

using a robot to place a high energy density device in the housing; and using the same or another robot to join the separable collar onto the housing such that the flange is received in the first groove and the first and second discs are received in the second and third grooves.

* * * * *